United States Patent [19]

Senatore

[11] 4,442,689

[45] Apr. 17, 1984

[54] LUBRICATING DIE HOLDER

[76] Inventor: Arnold Senatore, 605 Benningron Dr., Union, N.J. 07083

[21] Appl. No.: 348,950

[22] Filed: Feb. 16, 1982

[51] Int. Cl.[3] ..... B21C 9/00

[52] U.S. Cl. ..... 72/41; 72/286

[58] Field of Search ..... 72/41, 43, 44, 45, 286

[56] References Cited

U.S. PATENT DOCUMENTS

| | | | |
|---|---|---|---|
| Re. 20,067 | 8/1936 | Busey | 72/286 X |
| 2,119,516 | 6/1938 | Schuster | 72/286 X |
| 2,252,365 | 8/1941 | Fisher | 72/286 X |
| 3,946,582 | 3/1976 | Pietroni | 72/286 X |
| 3,973,426 | 8/1976 | Fujita et al. | 72/286 |

FOREIGN PATENT DOCUMENTS

| | | | |
|---|---|---|---|
| 395770 | 5/1924 | Fed. Rep. of Germany | 72/286 |

*Primary Examiner*—E. Michael Combs

[57] ABSTRACT

Lubricating die holder comprising a supportable body containing a die holder chamber having an entrance opening and an exit opening respectively extending therefrom to the front entrance side and rear exit side of the body and defining a die drawing path extending through the body from the entrance opening into the chamber and in turn from the chamber to the exit opening, the chamber being adapted to receive operatively movably therewithin a separate drawing die of the type capable of reducing the size of a wire passing along the path from the entrance side to the exit side of the body, and a lubricating coolant flow conduit system terminating in a feed aperture arrangement flow communicating with the chamber and entrance and exit openings and arranged for feeding lubricating coolant into direct contact with the die and wire in the chamber and in the entrance and exit openings, e.g. in a direction crosswise of the path, preferably with the chamber having a slide surface facing the entrance opening and crosswise of the path for sliding contact with the adjacent portion of the die to permit its self-centering relative to the path within the adjacent confines of the chamber, so that the die may be received operatively movably in the chamber in floating self-centering disposition therewithin relative to the path and arranged for direct contact of lubricating coolant therewith in any position of floating self-centering movement of the die relative to the feed aperture arrangement.

8 Claims, 4 Drawing Figures

LUBRICATING DIE HOLDER

The present invention relates to a lubricating die holder, and more particularly to such a die holder having a chamber for receiving a drawing die in floating self-centering disposition therein and means for feeding lubricating coolant into direct contact with the die and the article, e.g. wire, being drawn therethrough.

Various teachings regarding die holder arrangements for drawing dies are known, some of which make provision for cooling the die or for lubricating the article such as wire during the drawing thereof through the die to reduce its size, i.e. diameter.

FIELD AND BACKGROUND OF THE INVENTION

In this regard, U.S. Pat. No. 1,954,961 (Sutherland) concerns a wire drawing die stationarily secured in an enclosing holder which is provided with an annular water cooling recess surrounding the die but closed off from the die and drawing path for indirect heat exchange cooling of the die during the drawing of the wire along the path. No provision is made in this teaching, however, for continuously lubricating the die or wire, or for permitting self-centering of the die in the holder, or for direct contact of any lubricant or coolant with the die as well as with both the entering and exiting portions of the wire.

U.S. Pat. No. 3,740,990 (Prajsnar et al) shows a pair of tandem dies stationarily secured in an enclosing pressure sleeve holder arrangement providing hydrodynamic lubrication for the wire or the like being drawn therethrough, e.g. under high pressures up to 15,000 atmospheres, as well as indirect cooling of the die via a closed cooling channel surrounding the sleeve arrangement. In this teaching also, no provision is made for permitting self-centering of the dies, or for direct contact of any coolant with the dies and with both the entering and exiting portions of the wire.

U.S. Pat. No. 1,986,021 (Sjogren) shows a wire drawing die stationarily secured in an enclosing holder which is provided with a water cooling recess surrounding the die but closed off from the drawing path. Here again, no provision is made for permitting self-centering of the die, or for direct contact of any lubricant and/or coolant not only with the die but also with both the entering and exiting portions of the wire.

U.S. Pat. No. 2,502,471 (Mc Ilvried) concerns a wire drawing die lubricating apparatus including an upright apertured bracket on one side of which an externally disposed wire drawing die is stationarily secured in alignment with the bracket aperture, and an adjustable upwardly slanting tubular member whose upper notched end contacts the underside portion of the adjacent exposed entrance side of the die for supplying lubricant under pressure into direct contact with the entrance side of the die and the entering portion of the wire thereat. However, no provision is made for permitting self-centering of the die in the bracket, let alone in a die holder chamber thereof, or for direct contact of any lubricant or coolant with the exiting portion of the wire.

U.S. Pat. No. 2,277,339 (Luginbill et al.) shows an externally disposed disc shaped die holder or block containing a central diamond wire drawing die and axial coolant channels extending therethrough radially outwardly of the diamond die and wire drawing path, plus auxiliary radial outlet coolant channels flow connecting the axial channels with the die holder periphery. Hence, when the die holder is stationarily secured in upright or vertical position along a horizontal drawing axis with its entrance and exit sides completely exposed, coolant from a separate external nozzle adjacent the entrance side of the die will flow directly against the die and die holder thereat as well as the entering portion of the wire, with part of the coolant passing through the axial channels to the exposed exit side of the die holder and randomly outwardly therefrom. Alternatively, when the die holder is stationarily secured in such position but against a machine support closing off the exit apertures of the axial coolant channels on the exit side of the die holder, the part of the coolant passing into the axial channels with travel to the auxiliary radial outlet channels and flow randomly outwardly therefrom. Nevertheless, no provision is made for permitting self-centering of the die in a die holder, let alone in a die holder chamber thereof, or for continuously lubricating and/or cooling the die and wire by direct contact of a lubricant and/or coolant not only with the die but also with both the entering and exiting portions of the wire.

U.S. Pat. No. 2,188,470 (Brandt) shows a wire drawing die stationarily secured in an enclosing holder which is provided with an annular coolant recess surrounding the die but closed off from the die and drawing path for indirect heat exchange cooling of the die, plus lubricant escape ports in the entrance side portion of the holder radially outwardly of the die to relieve that area of excess pressure otherwise generated by collection of applied lubricant thereat. Here also, no provision is made for permitting self-centering of the die in the holder, or for direct contact of the coolant with the die as well as with both the entering and exiting portions of the wire.

U.S. Pat. No. 1,896,674 (Longwell) shows a pair of tandem wire drawing dies stationarily secured in an enclosing holder and having an enclosed pressure lubricant supplying annular channel axially between and flow communicating with the opposed inwardly facing sides of the dies for lubricating the wire portion extending between the dies. However, no provision is made for permitting self-centering of either die in the holder, or for direct contact of any lubricant and/or coolant with a given die and with both the entering and exiting portions of the wire thereat.

U.S. Pat. No. 2,679,680 (Hanks) shows a multi-stage wire drawing die arrangement in which lubricant such as soap may be supplied to the wire at the entrance side of certain dies, with one or more other dies mounted for floating or movable rotative disposition relative to the die holder thereof whereby to minimize friction during the overall wire treatment operation. Even so, no provision is made for direct contact of any lubricant and/or coolant with any given die as well as with both the entering and exiting portions of the wire thereat.

U.S. Pat. No. 2,257,644 (Pierce) shows a wire drawing die arrangement, in which the die holder or block containing the die is provided with internal coolant passages and is horizontally disposed in loosely resting adjustable contact on a horizontal apertured support portion of the arrangement such that the drawing axis extends vertically and the entrance side of the die faces upwardly for supplying a lubricant downwardly onto the entrance side of the die and the entering portion of the wire thereat. Vertical set screws in the horizontally disposed die block permit angular adjustment mechanically of the die block relative to the horizontal support portion. Nevertheless, no provision is made in this complex arrangement for permitting self-centering of the die relative to the horizontal support portion, or for direct contact of any coolant with the die as well as with both the entering and exiting portions of the wire.

SUMMARY OF THE INVENTION

It is among the objects and advantages of the present invention to overcome the above drawbacks and deficiencies of the prior art, and to provide a lubricating die holder having a die holder chamber for receiving, e.g. removably captively, a drawing die in floating or movable and more or less automatic self-centering disposition therein, and means for feeding lubricating coolant into direct contact with the die itself, e.g. in any position of floating self-centering movement thereof, as well as into direct contact with the article such as wire being drawn therethrough, and particularly such that the lubricating coolant flows into direct contact with both the entering and exiting portions of the article such as wire, for enhanced drawing efficiency with minimized friction and heat generation and concordantly maximized heat dissipation and direct heat exchange between the die and adjacent entering and exiting wire portions, on the one hand, and the lubricating coolant, on the other hand.

It is among the additional objects and advantages of the present invention to provide a die holder of the foregoing type in which the means for feeding the lubricating coolant are arranged for feeding the same in a direction crosswise of the drawing path through the die, and preferably via feed aperture means flow communicating with the die holder chamber interior and the portions thereof through which the entering and exiting wire portions pass.

It is among the further objects and advantages of the present invention to provide such a die holder as a compact unitary element in which the die holder chamber as well as the feed aperture means are provided.

It is among the still further objects and advantages of the present invention to provide such a die holder which may be produced in simple and inexpensive manner from low cost readily available material, which is of uncomplicated design, and which is robust and long wearing in use as well as easily manipulated and adjusted for insertion or exchange of a given drawing die therein and for drawing operation once such die is in operative disposition therein.

Other and further objects and advantages of the present invention will become apparent from a study of the within specification and accompanying drawings, in which:

DESCRIPTION OF THE PREFERRED EMBODIMENTS

Figure 1:
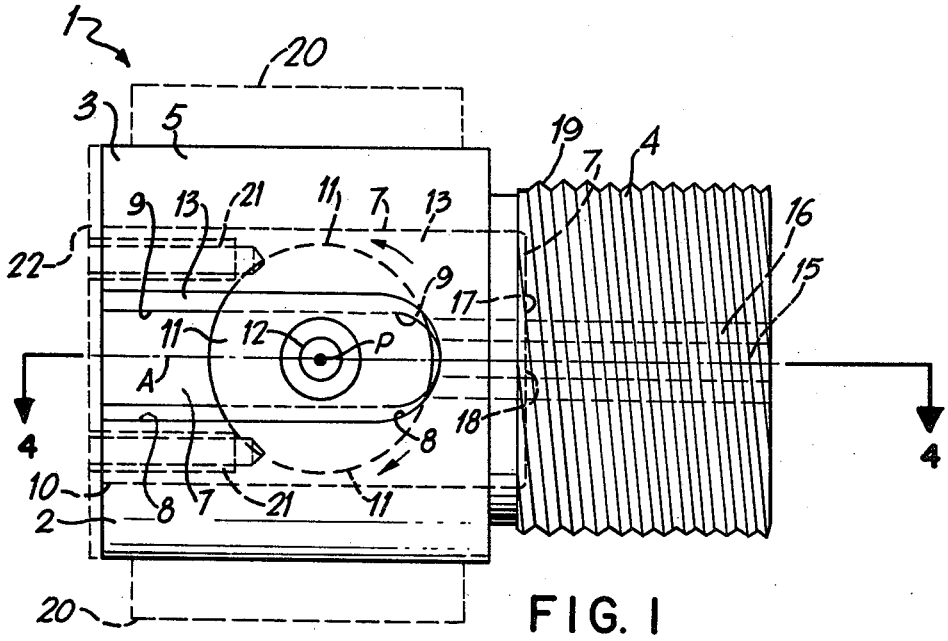
FIG. 1 is a schematic side elevational view of a lubricating die holder according to an embodiment of the present invention as seen from the front entrance side.

In accordance with the present invention, a lubricating die holder is advantageously provided, which comprises a body adapted to be mounted on a support, the body having a front entrance side and a rear exit side, and containing a die holder chamber, provided with an entrance opening extending therefrom to the entrance side and an exit opening extending therefrom to the exit side and defining a die drawing path extending through the body from the entrance opening into the chamber and in turn from the chamber to the exit opening, and lubricating coolant flow conduit means.

In this regard, the die holder chamber is adapted to receive operatively movably therewithin a separate drawing die of the type capable of reducing the size of a wire or the like type article passing along the drawing path from the entrance side to the exit side of the body, and the lubricating coolant flow conduit means, which desirably extend into the body, terminate in feed aperture means flow communicating with the chamber and with the entrance and exit openings and arranged for feeding lubricant coolant into direct contact with the die and article in the chamber and in the entrance and exit openings. More specifically, the die holder chamber may be provided with slide thrust bearing surface means operatively facing the entrance opening and arranged crosswise of, e.g. substantially normal to, the drawing path for sliding contact with the adjacent portion of the separate drawing die to permit self-centering of the die relative to the drawing path within the adjacent confines of the chamber.

Hence, such a separate die may be advantageously efficiently received operatively movably in the instant chamber in floating self-centering disposition therewithin relative to the drawing path, i.e. as distinguished from being stationarily secured in place in a die holder, bracket or other support at a constant or fixed distance to the drawing path, and at the same time such die may be arranged for direct contact of lubricating coolant therewith in any position of floating self-centering movement of the die relative to the feed aperture means.

Favorably, the feed aperture means are preferably arranged for feeding lubricating coolant in a direction crosswise of the drawing die, e.g. substantially normal to the drawing path.

Moreover, preferably the entrance opening of the die holder chamber in the body may have a selective operative size width sufficient for passage of the article with clearance therethrough to the die in the chamber, and in turn the exit opening of the die holder chamber in the body may have a selective operative reduced size width relative to that of the entrance opening and sufficient for passage of the resultant drawn article with clearance therethrough from the die in the chamber.

Concordantly, the feed aperture means preferably may include an entrance feed aperture or nozzle of selective flow cross section operatively arranged adjacent the entrance opening and correspondingly sized for feeding sufficient lubricating coolant to the entrance opening for lubricating and cooling the vicinal portions of the article and die thereat, and an exit feed aperture of selective reduced flow cross section relative to that of the entrance feed aperture and operatively arranged adjacent the exit opening and correspondingly sized for feeding sufficient lubricating coolant to the exit opening for cooling the vicinal portions of the resultant drawn article and die thereat.

According to a particularly preferred embodiment of the present invention a lubricating die holder is provided, which comprises a substantially hollow, e.g. unitary solid heat conductive, body adapted to be mounted on a support, and having a longitudinal axis extending from one longitudinal end portion to the opposite longitudinal end portion of the body.

The body has a front entrance side extending generally in the direction of the longitudinal axis and a rear exit side extending generally in the direction of such longitudinal axis, and contains a die holder chamber substantially enclosed therewithin and extending generally along the longitudinal axis and provided with an entrance slot opening extending outwardly therefrom to the entrance side and an exit slot opening extending outwardly therefrom to the exit side and defining a die drawing path extending generally crosswise of, e.g. substantially normal to, the longitudinal axis and through the body from the entrance opening into the chamber and in turn from the chamber to the exit opening.

Suitably, a die insertion slot is specifically provided in the body which extends generally along the longitudinal axis from the one longitudinal end portion of the body to the chamber. In this way, the chamber is adapted to receive operatively movably, e.g. captively, therewithin via the insertion slot a separate drawing die of the type capable of reducing the size of a wire or the like article passing along the drawing path from the entrance side to the exit side of the body.

In this regard, significantly the chamber is also specifically provided with slide thrust bearing surface means operatively facing the entrance opening and arranged crosswise, e.g. substantially normal to, the drawing path for sliding contact with the adjacent portion of the separate drawing die to permit self-centering of the die relative to the drawing path within the adjacent confines of the chamber.

In this preferred embodiment, the lubricating coolant flow conduit means suitably extend into the body generally from the opposite longitudinal end portion of the body and terminate in feed aperture means flow communicating with the chamber and with the entrance and exit openings and arranged for feeding lubricating coolant into direct flushing contact with the die and wire or the like article in the chamber and in the entrance and exit opening.

The feed aperture means specifically include an entrance feed aperture or nozzle operatively arranged adjacent the entrance opening for feeding lubricating coolant to the entrance opening for lubricating and cooling the vicinal portions of the wire or the like article and die thereat, and an exit feed aperture or nozzle operatively arranged adjacent the exit opening for feeding lubricating coolant to the exit opening for cooling the vicinal portions of the resultant drawn wire or the like article and die thereat.

Hence, an appropriately selectively sized and shaped die, i.e. concordant to the corresponding selectively sized and shaped die holder chamber, may be conveniently removably or exchangeably received operatively in the chamber in floating and more or less automatic self-centering disposition therein relative to the drawing path and arranged for direct contact of lubricating coolant therewith in any position of floating self-centering movement of the die relative to the feed apertures.

Desirably, the feed apertures or nozzles are arranged in the body, preferably being defined in a portion of the interior of the body itself, and adjacent the chamber and entrance and exit openings for feeding lubricating coolant in a direction crosswise of, e.g. substantially normal to, the drawing path.

More especially, in this preferred embodiment, the entrance opening has a selective operative size width sufficient for passage of the wire or the like article with clearance therethrough to the die in the chamber, and the exit opening has a selective operative reduced size width relative to that of the entrace opening and sufficient for passage of the resultant drawn wire or the like article with clearance therethrough from the die in the chamber. Concordantly, the entrance feed aperture or nozzle is of selective flow cross section correspondingly sized for feeding sufficient lubricating coolant to the entrance opening for lubricating and cooling such vicinal portions of the wire or the like article and die thereat, and the exit feed aperture or nozzle is of selective reduced flow cross section relative to that of the entrance feed aperture or nozzle and correspondingly sized for feeding sufficient lubricating coolant to the exit opening for cooling such vicinal portions of the resultant drawn wire or the like article and die thereat.

Figure 4:
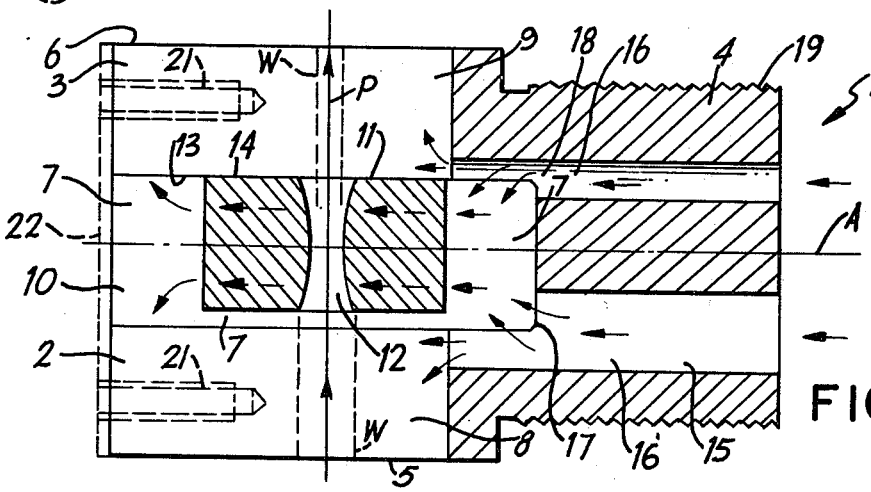
FIG. 4 is a schematic top sectional view taken along the line 4—4 of FIG. 1, and illustrating the relationships of various portions of the arrangement.

Refrering to the drawing, and especially FIGS. 1 and 4, a lubricating die holder 1 is shown, which may be advantageously constituted as a substantially hollow, preferably unitary solid heat conductive metallic, body 2. The body 2 may be of appropriate longitudinal and transverse dimensions and shape, and may be conveniently provided in the form of a partially excavated or hollowed out round rod or cylinder, having a longitudinal axis a extending from one longitudinal end portion, e.g. a die insertion end portion 3, to the opposite longitudinal end portion, e.g. a lubricating coolant supply end portion 4, of such body 2.

The body 2 has a front entrance side 5 extending generally in the direction of the longitudinal axis A and an opposed rear exit side 6 also extending generally in the direction of such axis A, and contains a die holder chamber 7, of selective longitudinal and transverse dimensions and shape, substantially completely enclosed within the body 2. The die holder chamber 7 similarly preferably extends generally along the longitudinal axis A within the body 2 and openly communicates with the exterior thereof via a front entrance slot opening 8 extending outwardly therefrom, e.g. radially, to the front entrance side 5 and separately via a rear exit slot opening 9 extending outwardly therefrom, e.g. also radially, to the rear exit side 6.

Thus, the positional disposition and relationship of the chamber 7, entrance slot opening 8 and exit slot opening 9 relative to each other and to the longitudinal axis A of the body 2 is such as to define a die drawing path P extending generally crosswise of, e.g. substantially normal to, the longitudinal axis A and completely through the body from the entrance opening 8 into the chamber 7 and in turn from the chamber 7 to the exit opening 9.

Additionally, a die insertion slot 10 is provided in the body 2 which accordingly extends generally along the longitudinal axis A from the die insertion end portion 3 to the die holder chamber 7, in effect forming a contiguous continuation or extension of the chamber 7 to the exterior of the body 2 in the direction of end portion 3, and preferably of the same cross-sectional dimensions and shape as the main portion of the chamber 7.

Desirably, the insertion slot 10 and chamber 7 are of such selective longitudinal and transverse dimensions and shape, and also of such confining and retentive internal wall configuration relative to the entrance slot opening 8 and exit slot opening 9, that a suitably complementally sized and shaped separate die 11 may be removably or exchangeably received operatively movably in the chamber 7 via the insertion slot 10. The die 11 as shown (see FIGS. 1 and 4), is a disc type die having a central working die opening 12, and an axial length or thickness preferably at least slightly less than the corresponding transverse width of the chamber 7 in the direction of the drawing path P.

It will be appreciated that the die 11 may be of the conventional type capable of reducing the size of a wire or the like article W, shown in phantom and of any solid or hollow cross sectional wire or the like article shape, as it is longitudinally or axial drawn through the die opening 12 of the die, i.e. as the article W is passed along the drawing path P from the entrance side 5 to the exit side 6 of the body 2.

Favorably, the entrance slot opening 8 and exit slot opening 9 are completely open at their lateral portions in the direction of the die insertion end portion 3 in the same manner as the insertion slot 10. Hence, a given die 11, already containing a wire or the like article W initially inserted through the die opening 12 thereof, may be efficiently inserted into the body 2 longitudinally along the axis A from the die insertion end portion 3 to the deeper confines of the chamber 7, and at the same time the adjacent portions of the article W will traverse the corresponding longitudinal extent of the entrance slot opening 8 and exit slot opening 9, until the die and article parts are in proper alignment with the die drawing path P.

The die holder chamber 7 is efficiently provided with slide thrust bearing surface means, here particularly in the form of the rear side internal wall portion 13, operatively facing the entrance slot opening 8 and arranged crosswise of, and preferably substantially normal to, the drawing path P, for sliding contact with the adjacent rear side external wall portion 14 of the separate drawing die 11 disposed in facing relation thereto, whereby to permit automatic self-centering of the die 11 relative to the drawing path P within the adjacent confines of the chamber 7 thereat.

The lubricating die holder 1 significantly also has lubricating coolant flow conduit means 15, operatively extending into the body 2 and flow connectable to a pressure or other source (not shown) of flowable lubricating coolant, e.g. an aqueous liquid of oleaginous lubricant constitution such as a water based fatty lubricant constituent solution or emulsion of the conventional type used in wire drawing operations.

The lubricating coolant flow conduit means 15 may desirably extend into the body 2 generally from the lubricating coolant supply end portion 4 thereof. Of major advantage in accordance with the present invention, however, is the fact that the lubricating coolant flow conduit means 15 extend into the die holder 1, or more specifically into the body 2, such that they terminate in feed aperture means or nozzle means 16 directly and openly flow communicating with the die holder chamber 7 as well as with both the front entrance slot opening 8 and the rear exit slot opening 9, and arranged for feeding lubricating coolant into direct, e.g. flushing, contact correspondingly with the die 11 and the wire or the like article W in the chamber 7 as well as in both the entrance opening 8 and exit opening 9.

More specifically, the feed aperture means 16 include a separate entrance feed aperture or nozzle 17 operatively extending through the body 2 and arranged adjacent the entrance opening 8 for feeding lubricating coolant to the entrance opening for lubricating and cooling the vicinal portions of the wire or the like article W and the die 11 thereat, and a separate exit feed aperture or nozzle 18 operatively extending through the body 2 and arranged adjacent the exit opening 9 for feeding lubricating coolant to the exit opening for cooling the vicinal portions of the resultant drawn wire or the like article W and the die thereat.

Of course, such entrance feed aperture 17 and exit feed aperture 18 are also arranged adjacent the corresponding transitional entrance and exit portions of the chamber 7, i.e. relative to the drawing path P for appropriate feeding of lubricating coolant also against the adjacent periphery of the die 11 within the chamber 7 and upwardly over as well as downwardly under the die 11 in a direction crosswise of the drawing path P, e.g. generally along the longitudinal axis A from the lubricating coolant supply end portion 4 to the die insertion end portion 3, and thus preferably in a flow direction substantially normal to the drawing path P.

The overall flow course and sub paths of flow of the lubricating coolant, fed via the separate entrance feed aperture 17 and exit feed aperture 18 into the chamber 7 and entrance slot opening 8 and exit slot opening 9, may be seen from the disposition of the flow directional arrows (see FIGS. 1 and 4). Appropriate clearance should be selectively provided between the top and bottom wall portions of the die 11 and the top and bottom confining internal wall portions of the chamber 7, as well as between the front surface wall portion of the die and the rearwardly facing front internal wall portion of the chamber, so as to insure free flow of the lubricating coolant along such sub-paths of flow.

Thus, the feed apertures 17 and 18 are appropriately arranged in the body 2, and advantageously are desirably separately defined in a portion of the interior of the body 2 itself, for compact disposition immediately at the spatial area of the body 2 where the lubricating coolant will provide its most pronounced and intensive lubricating and coolant effect on the die 11 and the wire or the like article W, as the case may be, during the contemplated drawing operation.

In regard to a particularly preferred feature according to the present invention, the entrance slot opening 8 has a selective operative size transverse slot width, i.e as distinguished from its pronounced size longitudinal or axial slot length in the direction of the longitudinal axis A, which is sufficient for passage of the undrawn wire or the like article W with clearance therethrough to the die 11 in the chamber 7. Likewise, the exit slot opening 9 has a selective reduced size corresponding transverse slot width relative to that of the entrance opening 8, which is in turn sufficient for passage of the resultant drawn wire or the like article W with clearance therethrough from the die 11 in the chamber 7.

Concordantly therewith, the entrance feed aperture or nozzle 17 is of selective flow cross section correspondingly sized for feeding sufficient lubricating coolant, e.g. at a selective constant flow rate and corresponding cooling temperature, to the entrance opening 8 for lubricating and cooling such vicinal portions of the wire or the like article W and die 11 thereat. Similarly, the exit feed aperture or nozzle 18 is of selective reduced flow cross section relative to that of the entrance feed aperture 17 and correspondingly sized for feeding sufficient lubricating coolant, e.g. preferably at the same said selective constant flow rate and corresponding cooling temperature, to the exit opening 9 for cooling such vicinal portions of the resultant drawn wire or the like article W and die 11 thereat.

Figure 2:
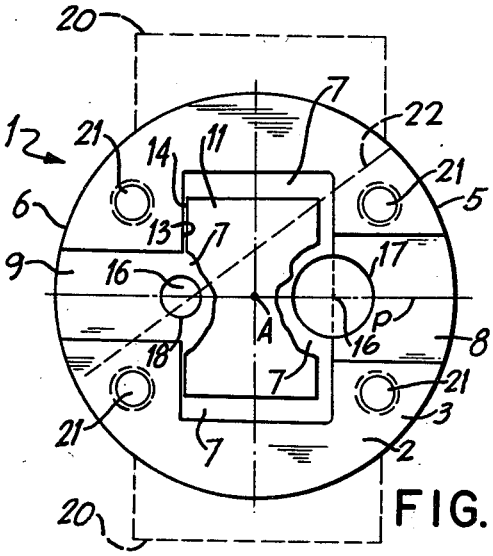
FIG. 2 is a schematic end view of the die holder of FIG. 1 as seen from the die insertion end portion thereof.
Figure 3:
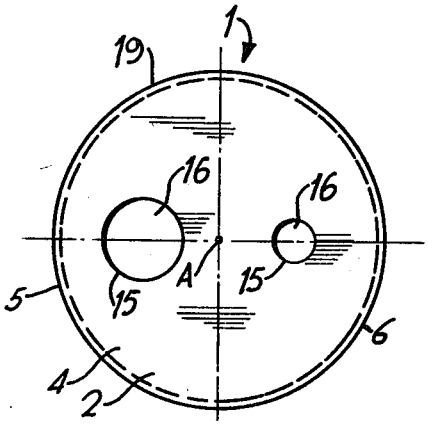
FIG. 3 is a schematic end view of the die holder of FIG. 1 as seen from the opposite or lubricating coolant supply end portion thereof.

As may be appreciated from FIG. 2, the transverse slot width of the entrance slot opening 8 is suitably larger than the flow cross section or diameter of the entrance feed aperture or nozzle 17, and the transverse slot width of the exit slot opening 9 is suitably larger than the flow cross section or diameter of the exit feed aperture or nozzle 18, and preferably also slightly larger than the flow cross section or diameter of the entrance feed aperture or nozzle 17.

Nevertheless, these various flow spaces and slot spaces may be varied as desired, so long as sufficient retention of the die 11 within the chamber 7 and operatively against the rear side internal wall portion 13 thereof is achieved, as well as adequate clearance of the wire or the like article W along the drawing path P through the body 2, and especially at the entrance opening 8 and exit opening 9.

This is particularly so, because the flow rate and temperature of the lubricating coolant can be controlled selectively as desired in conventional manner, for individual passage independently through each of the separate feed apertures 17 and 18, constituting the feed aperture means 16 of the flow conduit means 15 of the system, for effecting the contemplated lubricating and cooling of the die 11 and wire or the like article W in a zonal manner.

Hence, more intense localized lubricating and cooling may be achieved at the entrance side or working side of the die 11 and article W in the body 2, and less intense or residual localized cooling may be achieved in coordinated fashion therewith at the exit side of such die and article in the body, for more precise and efficient overall lubricating and cooling effect throughout.

It will be appreciated that the source of lubricating coolant may be suitably supplied to the flow conduit means 15 by attaching a supply coupling (not shown) of a conventional supply conduit, provided at the die drawing station, to the lubricating coolant supply end portion 4 of the body 2 via the external screw threads 19 thereon, or by other appropriate releasable connecting means.

Such supply coupling may be contained on the main support (not shown) on which the lubricating die holder 1 of the present invention is mounted, e.g. via a conventional adjustment clamp 20, shown in phantom, for releasable positioning of the die holder 1 on the main support, i.e. in line with an upstream feed means, e.g., a payout reel (not shown), and a downstream recovery means, e.g. a takeup reel (not shown), for the wire or the like article W, disposed in spaced relation thereto along the drawing path P in conventional manner and for the desired drawing operation purposes.

It will be appreciated that advantageously the body 2 may be suitably provided with a round girth or cylindrical elongated shape, i.e. in cross wise orientation to the drawing path P, thereby permitting the die holder 1 to be readily aligned precisely between the upstream feed means and downstream recovery means of the system via the clamp 20, both in terms of the axial position of the body 2 along the longitudinal axis A and the rotational angular or arc position of the body 2 about the longitudinal axis A.

In this way, the entrance slot opening 8 and exit slot opening 9 may be aligned in proper relation to the drawing path P for desired accurate positioning of the rear side internal wall portion 13 of the chamber 7 in more or less normal or perpendicular relation to the drawing path P and in turn concordant positioning of the die opening 12 of the die 11 in the chamber 7 in more or less coaxial relation to such drawing path P.

The die insertion end portion 3 of the body 2 may be conveniently provided with four equally spaced apart screw holes 21, i.e. offset from the hollow internal portions of the body 2 defining the die insertion slot 10, entrance opening 8, exit opening 9 and medially located chamber 7, for accommodating a retaining end plate or rebound plate 22, shown in phantom, which is preferably removably mounted on the adjacent end face of the insertion end portion 3 via screws extending into such holes 21.

The end plate 22 serves to retain the die 11 protectively captively within the chamber 7 and also to prevent excess overspray or overflow of lubricating coolant axially outwardly beyond that end of the body 2, especially in the vicinity of the comparatively wider entrance slot opening 8. Such end plate 22 may be provided to cover completely the entire end face of the body 2 thereat, but normally it is sufficient if end plate 22 is of approximately half moon shape (see FIG. 2), whereby to cover the roughly half circular zonal portion containing the entrance slot opening 8.

It will be appreciated that such half moon end plate 22 may be simply attached by two screws in the diametrically opposed pair of screw holes 21 nearest the overlapping straight edge portion of chord edge of the half moon plate. Hence, in inserting and removing a given die 11 via the insertion slot 10, only one such screw need be removed and the other merely loosened and used as a pivot to swing the end plate out of the way.

On the other hand, if the orientation of the drawing arrangement is such that the direction of drawing is diametrically opposite to the right to left direction as contemplated in FIG. 2, then the body 2 is merely rotated 180 degrees to the upside down position in which the entrance slot opening 8 is on the left and the exit slot opening 9 is on the right in terms of FIG. 2, and the half moon end plate 22 repositioned in the remaining two diametrically opposed screw holes 21, i.e. in upside down crosswise relation to the disposition shown in FIG. 2.

Of course, a suitable catch pan or the like (not shown) may be provided below the die holder 1 to catch and recover the outwardly and downwardly flowing lubricating coolant as it spills radially outwardly from the entrance slot opening 8 and exit slot opening 9, and perhaps also residually axially outwardly from the portion of the exit slot opening 9 not covered by the half moon end plate 22, as well as any adhering portions dripping from the wire or the like article W along the drawing path P.

Such recovered portions of the lubricating coolant may be conveniently collected for recycling in conventional manner to the supply source for refeeding to the flow conduit means 15.

Hence, the main purpose of the individual flows of lubricating coolant via the separate feed apertures 17 and 18 is to wash or bathe the entering and exiting portions of the wire or the like article W as well as the die 11 itself within the adjacent confines of the chamber 7 and along the entrance opening 8 and exit opening 9 with sufficient lubricating coolant to lubricate and cool the entering wire and die zonal portions and to cool the exiting wire and die zonal portions, i.e. without regard to spillage. This spillage can be taken care of by the use of an appropriately sized catch pan, preferably in conjunction with a suitably shaped and sized end plate 22, as described above.

In any case, the overall attributes of the lubricating die holder 1, according to the present invention, permit any appropriately selectively sized and shaped separate die, or die block, which is concordant to the corresponding selective size and shape of the die holder chamber 7, to be conveniently and rapidly removably or exchangeably received operatively in the chamber. More significantly, such attributes permit any such die or die block to be received operatively in the die holder chamber 7 in floating and more or less automatic self-centering disposition therein relative to the drawing path P as well as arranged therein for direct contact of the lubricating coolant therewith in any position of floating self-centering movement of the die relative to the feed apertures 17 and 18.

Thus, the die 11 is effectively captively operatively enclosed within the chamber 7 and is arranged therein relative to the rear side internal wall portion 13 thereof as slide thrust bearing surface means, to permit such self-centering to be freely effected in automatic, yet thrust borne, manner while the entirety of the adjacent internal confines of the die holder 1 including the wall portion 13, as well as the die and wire or the like article, are maintained in a lubricated and cooled control environment.

The instant lubricating die holder system is of especially significant advantage in connection with, for example, the drawing of copper wire, wherein it is desired to inhibit any adverse overheating of the wire and die caused by the intense frictional heat generated as the wire passes through the drawing die. Such inhibition is readily achieved both by supplying lubricant to reduce such friction at the drawing site and by supplying coolant to remove effectively from such site that heat which is so generated.

By arranging the chamber 7, insertion slot 10, entrance opening 8, exit opening 9, and separate feed apertures 17 and 18 of the feed aperture means 16 comprising the flow conduit means 15, all suitably within the confines of the body 2, a more compact unitary solid heat conductive, albeit somewhat hollow internal space containing, die holder 1 is provided, which is readily mountable on a support for use, and in which any appropriate die may be operatively received in self-centering disposition and in direct line with the feed apertures for appropriate drawing operation under controlled lubrication and cooling conditions.

It will be appreciated that the foregoing specification and accompanying drawings are set forth by way of illustration and not limitation, and that various modifications and changes may be made therein without departing from the spirit and scope of the present invention which is to be limited solely by the scope of the appended claims.

What is claimed is:

1. Lubricating die holder comprising a body adapted to be mounted on a support, the body having a front entrance side and a rear exit side, and containing a die holder chamber provided with an entrance opening extending therefrom to the entrance side and an exit opening extending therefrom to the exit side and defining a die drawing path extending through the body from the entrance opening into the chamber and in turn from the chamber to the exit opening, the chamber being adapted to receive operatively movably therewithin a separate drawing die of the type capable of reducing the size of a wire or the like type article passing along the drawing path from the entrance side to the exit side of the body, and lubricating coolant flow conduit means extending into the body and terminating in feed aperture means flow communicating directly with the chamber and directly with the entrance and exit openings and arranged for feeding lubricating coolant in a direction crosswise of the drawing path and into direct contact with the die and article in the chamber and in the entrance and exit openings, wherein the body is provided with a substantially cylindrical elongated shape having a longitudinal axis extending in crosswise orientation to the drawing path for permitting the die holder to be mounted on a support via a coacting clamp means, for readily aligning the die holder precisely between an upstream feed means for feeding the wire or the like article along the drawing path to the separate drawing die through the entrance opening and a downstream recovery means for recovering the reduced size wire or the like article along the drawing path from the separate drawing die through the exit opening, both in terms of the axial position of the body along such longitudinal axis relative to the drawing path and the rotational angular position of the body and of the entrance opening and exit opening about such longitudinal axis relative to the drawing path.

2. Holder of claim 1 wherein the chamber is provided with slide thrust bearing surface means operatively facing the entrance opening and arranged crosswise of the drawing path for sliding contact with the adjacent portion of the separate drawing die to permit self-centering of the die relative to the drawing path within the adjacent confines of the chamber.

3. Holder of claim 2 wherein a separate die is received operatively movably in the chamber in floating self-centering disposition therewithin relative to the drawing path and in sliding contact with the slide thrust bearing surfaces means and arranged generally in direct line with the feed aperture means for direct flushing contact of lubricating coolant therewith in any position of floating self-centering movement of the die relative to the feed aperture means.

4. Holder of claim 1 wherein the entrance opening has a selective operative size width sufficient for passage of the article with clearance therethrough to the die in the chamber, and the exit opening has a selective operative reduced size width relative to that of the entrance opening and sufficient for passage of the resultant drawn article with clearance therethrough from the die in the chamber, and concordantly wherein the feed aperture means include an entrance feed aperture of selective flow cross section operatively arranged adjacent the entrance opening and correspondingly sized for feeding sufficient lubricating coolant in a direction crosswise of the drawing path and directly to the entrance opening for lubricating and cooling the vicinal portions of the article and die thereat, and an exit feed aperture of selective reduced flow cross section relative to that of the entrance feed aperture and operatively arranged adjacent the exit opening and correspondingly sized for feeding sufficient lubricating coolant in a direction crosswise of the drawing path and directly to the exit opening for cooling the vicinal portions of the resultant drawn article and die thereat.

5. Lubricating die holder comprising a substantially hollow, compact unitary heat conductive, body adapted to be mounted on a support, and having a longitudinal axis extending from one longitudinal end portion to the opposite longitudinal end portion of the body, the body having at said one longitudinal end portion a front entrance side extending generally in the direction of the longitudinal axis and a rear exit side extending generally in the direction of such longitudinal axis, and containing a die holder chamber substantially enclosed therewithin and extending generally along the longitudinal axis and provided with an entrance slot opening extending outwardly therefrom to the entrance side and an exit slot opening extending outwardly therefrom to the exit side and defining a die drawing path extending generally crosswise of the longitudinal axis and through the body from the entrance opening into the chamber and in turn from the chamber to the exit opening, a die insertion slot in the body extending generally along the longitudinal axis from the one longitudinal end portion of the body to the chamber, the chamber being adapted to receive operatively movably therewithin via the insertion slot a separate drawing die of the type capable of reducing the size of a wire or the like article passing along the drawing path from the entrance side to the exit side of the body, the chamber being provided with slide thrust bearing surface means operatively facing the entrance opening and arranged crosswise of the drawing path for sliding contact with the adjacent portion of the separate drawing die to permit self-centering of the die relative to the drawing path within the adjacent confines of the chamber, and lubricating coolant flow conduit means extending into the body generally from said opposite longitudinal end portion of the body and terminating in feed aperture means flow communicating directly with the chamber and directly with the entrance and exit openings and arranged for feeding lubricating coolant in a direction crosswise of the drawing path and into direct flushing contact with the die and wire or the like article in the chamber and in the entrance and exit openings, and including an entrance feed aperture operatively arranged adjacent the entrance opening for feeding lubricating coolant in a direction crosswise of the drawing path and directly to the entrance opening for lubricating and cooling the vicinal portions of the wire or the like article and die thereat, and an exit feed aperture operatively arranged adjacent the exit opening for feeding lubricating coolant in a direction crosswise of the drawing path and directly to the exit opening for cooling the vicinal portions of the resultant drawn wire or the like article and die thereat.

6. Holder of claim 5 wherein the body is provided with a substantially cylindrical elongated shape extending along such longitudinal axis and in crosswise orientation to the drawing path for permitting the die holder to be mounted on a support via a coacting clamp means, for readily aligning the die holder precisely between an upstream feed means for feeding the wire or the like article along the drawing path to the separate drawing die through the entrance opening and a downstream recovery means for recovering the reduced size wire or the like article along the drawing path from the separate drawing die through the exit opening, both in terms of the axial position of the body along such longitudinal axis relative to the drawing path and the rotational angular position of the body and of the entrance opening and exit opening about such longitudinal axis relative to the drawing path.

7. Holder of claim 5 wherein a separate die is received operatively movably in the chamber in floating self-centering disposition therein relative to the drawing path and in sliding contact with the slide thrust bearing surface means and arranged generally in direct line with the feed apertures for direct flushing contact of lubricating coolant therewith in any position of floating self-centering movement of the die relative to the feed apertures.

8. Holder of claim 5 wherein the entrance opening has a selective operative size width sufficient for passage of the wire or the like article with clearance therethrough to the die in the chamber, and the exit opening has a selective operative reduced size width relative to that of the entrance opening and sufficient for passage of the resultant drawn wire or the like article with clearance therethrough from the die in the chamber, and concordantly wherein the entrance feed aperture is of selective flow cross section correspondingly sized for feeding sufficient lubricating coolant in a direction crosswise of the drawing path and directly to the entrance opening for lubricating and cooling such vertical portions of the wire or the like article and die thereat, and the exit feed aperture is of selective reduced flow cross section relative to that of the entrance feed aperture and correspondingly sized for feeding sufficient lubricating coolant in a direction crosswise of the drawing path and directly to the exit opening for cooling such vicinal portions of the resultant drawn wire or the like article and die thereat.

* * * * *